US005527447A

United States Patent [19]

Roof

[11] Patent Number: 5,527,447

[45] Date of Patent: Jun. 18, 1996

[54] TREATMENTS TO REDUCE ALDOL CONDENSATION AND SUBSEQUENT POLYMERIZATION IN DIETHANOLAMINE SCRUBBERS

[75] Inventor: Glenn L. Roof, Sugar Land, Tex.

[73] Assignee: Baker Hughes Incorporated, Houston, Tex.

[21] Appl. No.: 438,710

[22] Filed: May 11, 1995

[51] Int. Cl.[6] ..... C10G 9/16

[52] U.S. Cl. ..... 208/48 AA; 208/95; 208/236; 210/696; 210/698; 210/699; 252/186.28; 252/186.39; 252/187.32; 252/186.1

[58] Field of Search ..... 423/210; 208/48 AA, 208/95, 236; 210/696, 698, 699; 252/186.28, 186.36, 187.32, 186.1

[56] References Cited

U.S. PATENT DOCUMENTS

| | | | |
|---|---|---|---|
| 2,909,486 | 10/1959 | Colichman | 252/74 |
| 3,130,148 | 4/1964 | Gleim | 208/189 |
| 3,230,225 | 1/1966 | Arrigo | 260/290 |
| 3,380,960 | 4/1968 | Ebner | 260/666.5 |
| 3,396,154 | 8/1968 | Chamberlin et al. | 260/85.5 |
| 3,737,475 | 6/1973 | Mason | 260/683.15 |
| 3,769,268 | 10/1973 | George | 260/89.5 |
| 3,914,205 | 10/1975 | Gorecki et al. . | |
| 3,989,740 | 11/1976 | Broussard et al. | 260/486 R |
| 4,085,267 | 4/1978 | Morningstar et al. | 526/74 |
| 4,269,954 | 5/1981 | Morningstar et al. | 526/62 |
| 4,376,850 | 3/1983 | Sanner . | |
| 4,439,311 | 3/1984 | O'Blasny . | |
| 4,536,236 | 8/1985 | Haas . | |
| 4,585,579 | 4/1986 | Bommaraju et al. . | |
| 4,673,489 | 6/1987 | Roling . | |
| 4,952,301 | 8/1990 | Awbrey . | |
| 5,160,425 | 11/1992 | Lewis . | |
| 5,194,143 | 3/1993 | Roling . | |
| 5,220,104 | 6/1993 | McDaniel et al. . | |
| 5,288,394 | 2/1994 | Lewis et al. . | |

FOREIGN PATENT DOCUMENTS

| | | |
|---|---|---|
| 264280 | 10/1987 | European Pat. Off. . |

OTHER PUBLICATIONS

PSP Patent Bibliography 1955–1979, Process Stream Purification.

Chemical Abstracts, 119:118165, vol. 119, 1993, p. 25.

Herbert O. House, Modern Synthetic Reactions, 2nd edt., pp. 45–53, 71–73.

Jerry March, Advanced Organic Chemistry, 2nd edt., 1977, pp. 829–833, 1116–1118.

Sodium Borohydride Digest, Morton, pp. 1–10.

*Primary Examiner*—Michael Lewis
*Assistant Examiner*—Amy M. Harding
*Attorney, Agent, or Firm*—Rosenblatt & Redano

[57] ABSTRACT

The present invention provides a number of inhibiting agents that are useful to reduce aldol condensation in diethanolamine scrubbers. Suitable inhibiting agents include: hydrogen peroxide; hydroperoxides; nitroalkanes; salts of hypochlorous acid; alkyl substituted aldehyde oximes; trialkyl phosphites; isothiuronium salts; 2-mercaptoethanol ($C_2H_6OS$); and, benzoic hydrazide. A preferred inhibiting agent for diethanolamine scrubbers is an excess of hydrogen peroxide.

23 Claims, No Drawings

TREATMENTS TO REDUCE ALDOL CONDENSATION AND SUBSEQUENT POLYMERIZATION IN DIETHANOLAMINE SCRUBBERS

FIELD OF THE INVENTION

The present invention relates to the use of agents to reduce fouling caused by aldol condensation in diethanolamine (DEA) scrubbers. Suitable inhibiting agents include: hydrogen peroxide; hydroperoxides; nitroalkanes; salts of hypochlorous acid (commercial bleach, NaOCl and CaOCl); alkyl substituted aldehyde oximes; trialkyl phosphites; isothiuronium salts; 2-mercaptoethanol ($C_2H_6OS$); and, benzoic hydrazide. A preferred inhibiting agent for diethanolamine scrubbers is an excess of hydrogen peroxide.

BACKGROUND OF THE INVENTION

Refineries employ atmospheric and vacuum distillation towers to separate crude oil into narrower boiling fractions. These fractions then are converted into fuel products, such as motor gasoline, distillate fuels (diesel and heating oils), and bunker (residual) fuel oils. Some of the low boiling fractions from various units of the refinery are directed to petrochemical plants, where they are further processed into highly refined chemical feedstocks to be used as raw materials in the manufacture of other types of products, such as plastics and basic chemicals.

During the refining of petroleum, hydrocarbon streams typically are treated in an amine scrubber, such as a DEA or MEA scrubber, to remove acid gases, such as hydrogen sulfide and carbon dioxide. In a petrochemical plant, hydrocarbon streams typically are treated for the same purpose in a caustic scrubber. All of these scrubbers herein are referred to as "acid gas" scrubbers. The hydrocarbon stream entering an acid gas scrubber may contain aldehydes and ketones, their precursors, such as vinyl acetate, or other impurities, that are hydrolyzed or otherwise converted to aldehydes and salts of organic acids in the highly alkaline environment of an acid gas scrubber. Such compounds will herein be referred to as "reactive compounds." These reactive compounds either (a) contain carbonyls, or (b) form carbonyls under highly alkaline conditions that are susceptible to classic aldol condensation reactions. Carbonyls that are susceptible to classic aldol condensation reactions hereinafter will be referred to as "reactive carbonyls."

Under highly alkaline conditions, lower molecular weight aldehydes, such as propionaldehyde (propanal) and especially acetaldehyde (ethanal), readily undergo base catalyzed aldol condensation at ambient temperatures. The result is the formation of oligomers and polymers which precipitate out of the scrubbing solution as viscous oils, polymeric gums, and solids. These precipitates can foul the processing equipment and result in the reduction of processing throughput and costly equipment maintenance or repair.

In the past, organic reducing agents or organic and inorganic oxidizing agents have been proposed to prevent such polymerization. These organic agents might successfully retard polymerization in acid gas scrubbers; however, the organic agents also tend to undergo other reactions which can reduce their effectiveness as aldol condensation inhibitors.

Effective and economical methods for retarding aldol condensation in diethanolamine scrubbers would be highly desirable.

SUMMARY OF THE INVENTION

The present invention provides a number of inhibiting agents that are useful to reduce aldol condensation in diethanolamine scrubbers. Suitable inhibiting agents include: hydrogen peroxide; hydroperoxides; nitroalkanes; salts of hypochlorous acid (commercial bleach, NaOCl and CaOCl); alkyl substituted aldehyde oximes; trialkyl phosphites; isothiuronium salts; 2-mercaptoethanol ($C_2H_6OS$); and, benzoic hydrazide. A preferred inhibiting agent for diethanolamine scrubbers is an excess of hydrogen peroxide.

DETAILED DESCRIPTION OF THE INVENTION

The present invention is directed to reactions that cause fouling in diethanolamine scrubbers. Without limiting the present invention, it is believed that the red precipitate that forms in acid gas scrubbers is the result of several aldol condensation/dehydration steps. As used herein, the term "aldol condensation" is intended to refer to the reactions that ultimately result in the formation of a precipitate in acid gas scrubbers. The inhibiting agents of the present invention are believed to inhibit fouling by inhibiting such aldol condensation.

Hydrogen peroxide is a most preferred inhibiting agent for use in DEA scrubbers.

Other suitable agents for inhibiting aldol condensation in diethanolamine scrubbers include: hydroperoxides; nitroalkanes; salts of hypochlorous acid; alkyl substituted aldehyde oximes; and trialkyl phosphites.

Agents that are less preferred, because they are not as soluble in a diethanolamine scrubber solution, but that should inhibit aldol condensation in diethanolamine scrubbers are isothiuronium salts and 2-mercaptoethanol ($C_2H_6OS$).

Preferred hydroperoxides are tertiary-butyl hydroperoxide and cumene hydroperoxide. Tertiary-butyl hydroperoxide is commercially available from Arco Chemical Co., Chemicals Group, Newtown Square, Pa. Cumene hydroperoxide is commercially available from Elf Atochem North America, Inc., 2000 Market Street, Philadelphia, Pa.

Preferred nitroalkanes having the structure $R—NO_2$, wherein R is selected from the group consisting of straight, branched, and cyclic alkyl groups having between about 1–8 carbon atoms. A preferred nitroalkane is nitromethane, which is commercially available from Angus Chemical Co., 1500 East Lake Cook Road, Buffalo Grove, Ill.

Salts of hypochlorous acid are commonly available commercially as a 3.62% solution of NaOCl (household bleach) and in solid form as $Ca(OCl)_2$. An example of a commercial source is Mayo Chemical Co., Smyrna, Ga.

Preferred alkyl substituted aldehyde oximes are those in which the alkyl groups are selected from the group of straight, branched, and cyclic alkyl groups having between about 1–8 carbon atoms. A most preferred alkyl substituted aldehyde oxime is acetaldehyde oxime, which is commercially available from AlliedSignal, Morristown, N.J.

Preferred trialkyl phosphites have the general structure $(RO)_3P$, in which R is a straight, branched, or cyclic alkyl group having between about 1–8 carbon atoms. A most preferred trialkyl phosphite is trimethyl phosphite, which is commercially available from Akzo, Nobel Chemicals, Inc., 300 Riverside Plaza, Chicago, Ill. 60606.

A preferred isothiuronium salt is benzyl isothiuronium chloride, which may be manufactured as shown in Example 1. Persons of skill in the art can alter the starting materials in the procedures of Example 1 to manufacture other isothiuronium salts.

Preferably, the inhibiting agent should be injected into the scrubber slowly, on an "as-needed" basis. Due to substantially continuous mode of operation of most scrubbers, it is believed that the agent should reach a steady state during processing. An equimolar ratio of inhibiting agent to active carbonyl containing compound should be sufficient to inhibit aldol condensation. Even less than a 1:1 ratio may be sufficient. An excess of inhibiting agent may be added, if desirable.

The agents of the present invention will react with the reactive carbonyls, or a condensation product of two or more reactive carbonyls, in the acid gas scrubber at ambient temperatures. Therefore, the hydrocarbon stream need not be heated. In the following examples, the samples are heated to between about 50°–55° C. (122°–131° F.) to hasten the polymerization reaction for facile candidate evaluation. In actual use, heating is neither necessary nor advisable.

The invention will be more readily understood with reference to the following examples.

EXAMPLE 1

Thiourea (7.60 g; 100 mmoles) was added to 150 ml of ethanol in a 250 ml Erlenmeyer flask. The mixture was hearted to reflux to dissolve almost all of the thiourea. After cooling the contents to 40° C., benzyl chloride (12.6 g; 100 mmoles) was added dropwise over three minutes. The slightly hazy solution was refluxed overnight, causing it to become clear. In the morning, the ethanol was stripped off on the rotary evaporator leaving a good yield of a white solid. NMR analysis of the white solid showed it to be benzylisothiuronium chloride.

EXAMPLE 2

A number of candidates were screened for use in DEA (diethanolamine) scrubbers. To perform the screening, 2 oz. bottles were dosed with 32,000 ppm of candidate. 25 ml of 20% DEA was added to each bottle, and the bottles were shaken. Subsequently, 300 μl of vinyl acetate (4,000 ppm) was added to each bottle, and the bottles were shaken, placed in an oven at 55° C. (131° F.), and observed as a function of time for at least 24 hours for color and precipitate formation. Candidates that exhibited no color, or only slight color, and no precipitation were selected for further study. Approximately 24 candidates were selected for further testing.

EXAMPLE 3

Three more candidates were screened in this experiment. Two oz. bottles were dosed with 1.5 g of candidate (except for candidate 2) followed by 25 ml of 20% DEA and then 300 μl of vinyl acetate. The samples were shaken and placed in an oven at 55° C. (131° F.) and observed at one minute and 18 hours. The source and amount of the candidate are shown in Table I:

TABLE I

| SAMPLE | CANDIDATE | SOURCE | DOSE |
|---|---|---|---|
| Blank | — | — | — |
| Control 1 | Hydroxylamine hydrochloride | Fisher Chemical Co. | 1.5 gm |
| 1 | 29% $H_2O_2$ | EM Science, EM Industries, Inc. | 1.5 gm |
| 2 | Commercial Bleach (3.62% NaOCl) | — | 3.0 gm |
| 3 | $I_2$ | Mallinckrodt | 1.5 gm |

The results are shown in Table II:

TABLE II

| SAMPLE | 1 MINUTE | 18 HOURS |
|---|---|---|
| Blank | Colorless | Red solution; reddish-beige precipitate. |
| Control 1 | Colorless | Colorless, no haze or precipitate. |
| 1 | Colorless | Yellow, no haze or precipitate. |
| 2 | Colorless | Red solution. slight haze. |
| 3 | Voluminous yellow precipitate of apparently $I_3CH$ | Red solution and large amount of presumably $I_3CH$ |

Based on the foregoing, candidates 1 (hydrogen peroxide) and 2 (NaOCl) are preferred agents for inhibiting aldol condensation in DEA scrubbers because the solution has only minimal color and no haze or precipitate is present. Candidate 3 (iodine) appears to be a suitable agent for inhibiting aldol condensation in DEA scrubbers; however, a large amount of presumably iodoform was formed in this sample. Potential users should be informed of the potential for formation of this precipitate.

EXAMPLE 4

Ten of the candidates from Example 2 were tested under stoichiometric conditions in this experiment. Two oz. bottles were dosed with 3.56 mmoles of candidate (except for candidates 3 and 4, which inadvertently were misdosed), 25 ml of 20% DEA, and 300 μl of vinyl acetate (280 mg; 3.24 mmoles). The samples were shaken and placed in an oven at 50° C. (122° F.) and observed after 24 hours. The amount of candidate added is shown in Table III:

TABLE III

| SAMPLE | CANDIDATE | SOURCE | MW | AMOUNT ADDED | MMOLES |
|---|---|---|---|---|---|
| Blank | — | | | — | — |
| 1 | Benzyl isothiuronium chloride | Synthesized as in Ex. 1 | 202 | 719 mg | 3.56 |

TABLE III-continued

| SAMPLE | CANDIDATE | SOURCE | MW | AMOUNT ADDED | MMOLES |
|---|---|---|---|---|---|
| 2 | $HOCH_2CH_2SH$ | Aldrich Chemical Co. | 78.1 | 278 mg | 3.56 |
| 3 | 70% tertiary-butyl hydroperoxide | Arco Chemical Co. | 90 | 801 mg | 6.23 |
| 4 | Tertiary-butyl perbenzoate | Aztec Catalyst Co. | 194 | 491 mg | 2.53 |
| 5 | Aniline | Aldrich Chemical Co. | 93.1 | 331 mg | 3.56 |
| 6 | Benzyl amine | Aldrich Chemical Co. | 107 | 381 mg | 3.56 |
| 7 | Benzoic Hydrazide | Aldrich Chemical Co. | 136 | 484 mg | 3.56 |
| 8 | Acetaldehyde oxime | Allied Signal | 59.1 | 210 mg | 3.56 |
| 9 | Benzaldehyde oxime | Aldrich Chemical Co. | 121 | 431 mg | 3.56 |

The results are shown in Table IV:

TABLE IV

| SAMPLE | 24 HOURS |
|---|---|
| Blank | Red solution and beige precipitate on bottom |
| 1 | Light yellow solution; yellow liquid on bottom, probably unreacted candidate |
| 2 | Light yellow sol'n; heavy off-white precipitate on bottom; a little red precipitate on bottom |
| 3 | Yellow solution, no haze, no precipitate |
| 4 | Yellow solution, no haze, unreacted candidate on bottom |
| 5 | Yellow solution, red haze, and some red precipitate on bottom |
| 6 | Yellow solution, red haze, and some red precipitate on bottom |
| 7 | Light yellow solution, white solid precipitate--probably unreacted candidate |
| 8 | Red solution, no haze no precipitate |
| 9 | Red solution, hazy, red precipitate on bottom |

Based on the foregoing, candidates 3 (t-butyl hydroperoxide) and 8 (acetaldehyde oxime) appear to be suitable agents for inhibiting aldol condensation in DEA scrubbers, and candidates 1, 2, 4, and 7—benzyl isothiuronium chloride, 2-mercaptoethanol, t-butyl perbenzoate, and benzoic hydrazide, respectively—may be suitable agents for DEA scrubbers provided that the presence of some precipitate in the scrubber is acceptable, or the candidate is dosed at a lower soluble level.

EXAMPLE 5

Ten of the candidates from Example 2 were tested under stoichiometric conditions in this experiment. Two oz. bottles were dosed with 3.56 mmoles of candidate, 25 ml of 20% DEA, and 300 μl of vinyl acetate (280 mg; 3.24 mmoles). The samples were shaken and placed in an oven at 50° C. (122° F.) and observed after 24 hours. The amount of candidate added is shown in Table V:

TABLE V

| SAMPLE | CANDIDATE | SOURCE | MW | AMOUNT ADDED (mg) | MMOLES |
|---|---|---|---|---|---|
| Blank | — | | | — | — |
| 1 | Acetophenone | Aldrich Chemical Co. | 120 | 427 | 3.56 |
| 2 | Thiourea | Aldrich Chemical Co. | 76.1 | 271 | 3.56 |
| 3 | Thiophenol | Aldrich Chemical Co. | 110 | 392 | 3.56 |
| 4 | Dibutyl amine | BASF Corp. | 129 | 459 | 3.56 |
| 5 | Nitromethane | Aldrich Chemical | 61.0 | 217 | 3.56 |

TABLE V-continued

| SAMPLE | CANDIDATE | SOURCE | MW | AMOUNT ADDED (mg) | MMOLES |
|---|---|---|---|---|---|
| | | Co. | | | |
| 6 | Trimethyl phosphite | Aldrich Chemical Co. | 124 | 441 | 3.56 |
| 7 | Benzaldehyde | Aldrich Chemical Co. | 106 | 377 | 3.56 |
| 8 | 2 Benz-aldehyde/ 1 acetone | — | 212/ 58.0 | 754/ 206 | 3.56 |
| 9 | 30% $H_2O_2$ | EM Science | 34.0 | 403 | 3.56 |
| 10 | 3.62% NaOCl | Grocery store | 74.4 | 7,320 | 3.56 |

The results are shown in Table VI:

TABLE VI

| SAMPLE | 24 HOURS |
|---|---|
| Blank | Red solution and beige precipitate on bottom |
| 1 | Yellow solution, red precipitate on bottom |
| 2 | Red solution, red precipitate on bottom |
| 3 | Yellow solution, red precipitate on bottom |
| 4 | Red solution and insoluble candidate on top |
| 5 | Yellow solution, no haze, no precipitate |
| 6 | Yellow solution, intractable red oil on bottom |
| 7 | Yellow solution, intractable red oil on bottom |
| 8 | Red solution, hazy; beige precipitate on bottom |
| 9 | Red solution, no haze, no precipitate. |

Based on the foregoing, candidates 5 (nitromethane), 6 (trimethyl phosphite), and 10 (NaOCl) appear to be a suitable agents for inhibiting aldol condensation in DEA scrubbers.

EXAMPLE 6

The successful candidates from the DEA testing were evaluated for their ability to perform in a mixture of "lean" and "fat" DEA from a potential customer's DEA scrubber. 600 ml of "lean" DEA and 200 ml of "fat" DEA from a customer were vacuum filtered, mixed, and then filtered again through #1 paper. Two oz. bottles were dosed with 3.56 mmoles of candidate, to result in 1.1 moles of candidate per 1.0 mole of vinyl acetate, except for candidate 1 which was misdosed. 25 ml of haze-free "fat/lean" DEA was added to each bottle, and the bottles were shaken 100 times. Each bottle then was dosed with 300 μl of vinyl acetate (280 mg; 3.24 mmoles), and the bottles were shaken 50 times. The bottles were then placed in a 50° C. (122° F.) oven and observed after 24 hours. The amount of candidate added is shown in Table VII:

TABLE VII

| SAMPLE | CANDIDATE | SOURCE | MW | AMOUNT ADDED | MMOLES |
|---|---|---|---|---|---|
| Blank | — | — | — | — | — |
| 1 | 70% t-butyl hydroperoxide | Arco Chemical Co. | 90 | 801 mg | 6.23 |
| 2 | Acetaldehyde oxime | Allied Signal | 59.1 | 210 mg | 3.56 |
| 3 | Nitromethane | Angus Chemical Co. | 61.0 | 217 mg | 3.56 |
| 4 | Trimethyl phosphite | Aldrich Chemical Co. | 124 | 441 mg | 3.56 |
| 5 | 3.62% NaOCl (commercial bleach) | Grocery store | 74.4 | 7,320 mg | 3.56 |

At time zero, all samples were hazy because it was impossible to remove all of the haze by filtration. The results are shown in Table VIII:

TABLE VIII

| SAMPLE | 24 HOURS |
|---|---|
| Blank | Red solution and dark red precipitate on bottom |
| 1 | Dark red solution, no precipitate |
| 2 | Red solution, some red precipitate |
| 3 | Dark red solution, no precipitate |

TABLE VIII-continued

| SAMPLE | 24 HOURS |
|---|---|
| 4 | Yellow solution, haze, and some red precipitate |
| 5 | Dark red solution, heavy red precipitate |

Based on the foregoing, candidates 1 (t-butyl hydroperoxide), 2 (acetaldehyde oxime), and 3 (nitromethane) appear to be a suitable agents for inhibiting aldol condensation in DEA scrubbers. Candidate 4 (trimethyl phosphite) produced some red precipitate (but less than that produced in the blank), produced a lighter color solution, and may be a suitable agent for some DEA scrubbers.

Persons of skill in the art will appreciate that many modifications may be made to the embodiments described herein without departing from the spirit of the present invention. Accordingly, the embodiments described herein are illustrative only and are not intended to limit the scope of the present invention.

I claim:

1. A method for inhibiting aldol condensation in diethanolamine scrubbers comprising the step of treating a diethanolamine scrubbing solution with an inhibiting agent in an amount sufficient to inhibit said aldol condensation, wherein said inhibiting agent is selected from the group consisting of hydrogen peroxide, hydroperoxides, nitroalkanes, salts of hypochlorous acid, alkyl substituted aldehyde oximes, and trialkyl phosphites.

2. The method of claim 1 wherein said inhibiting agent is selected from the group consisting further of isothiuronium salts, 2-mercaptoethanol; and, benzoic hydrazide.

3. The method of claim 1 wherein said inhibiting agent is selected from the group consisting of acetaldehyde oxime, NaOCl, tertiary-butyl hydroperoxide, and nitromethane.

4. The method of claim 1 wherein said inhibiting agent comprises a hydroperoxide.

5. The method of claim 4 wherein said hydroperoxide is selected from the group consisting of tertiary-butyl or cumene hydroperoxide.

6. The method of claim 1 wherein said inhibiting agent comprises a nitroalkane.

7. The method of claim 6 wherein said nitroalkane has the following general structure $$R—NO_2$$

wherein R is selected from the group consisting of straight, branched, and cyclic alkyl group having between about 1–8 carbon atoms.

8. The method of claim 6 wherein said nitroalkane comprises nitromethane.

9. The method of claim 1 wherein said inhibiting agent comprises a salt of hypochlorous acid.

10. The method of claim 1 wherein said inhibiting agent comprises NaOCl.

11. The method of claim 1 wherein said inhibiting agent comprises an alkyl substituted aldehyde oxime wherein said alkyl groups are selected from the group of straight, branched, and cyclic alkyl groups having between about 1–8 carbon atoms.

12. The method of claim 1 wherein said inhibiting agent comprises acetaldehyde oxime.

13. The method of claim 1 wherein said inhibiting agent comprises a trialkyl phosphite having the general structure $$(RO)_3P$$

wherein R is selected from the group consisting of straight, branched, and cyclic alkyl groups having between about 1–8 carbon atoms.

14. The method of claim 13, wherein said trialkyl phosphite comprises trimethyl phosphite.

15. The method of claim 1 wherein said inhibiting agent comprises an isothiuronium salt.

16. The method of claim 15 wherein said isothiuronium salt comprises benzyl isothiuronium chloride.

17. The method of claim 1 wherein said hydrocarbon stream contains a molar concentration of reactive carbonyls, and wherein said hydrocarbon stream is treated with a molar amount of said inhibiting agent that is at least substantially the same as said molar amount of said reactive carbonyls.

18. A method for inhibiting aldol condensation in diethanolamine scrubbers comprising the step of treating a diethanolamine scrubbing solution with an inhibiting agent in an amount sufficient to inhibit said aldol condensation, wherein said inhibiting agent comprises hydrogen peroxide.

19. A diethanolamine scrubbing solution comprising an inhibiting agent in an amount sufficient to inhibit aldol condensation, wherein said inhibiting agent is selected from the group consisting of hydrogen peroxide, hydroperoxides, nitroalkanes, salts of hypochlorous acid, alkyl substituted aldehyde oximes, trialkyl phosphites.

20. The diethanolamine scrubbing solution of claim 19 wherein said inhibiting agent comprises hydrogen peroxide.

21. The diethanolamine scrubbing solution of claim 19 wherein said inhibiting agent is selected from the group consisting further of isothiuronium salts and 2-mercaptoethanol.

22. The method of claim 21 wherein said hydrocarbon stream contains a molar concentration of reactive carbonyls, and wherein said hydrocarbon stream is treated with a molar amount of said inhibiting agent that is at least substantially the same as said molar amount of said reactive carbonyls.

23. A method for inhibiting aldol condensation in diethanolamine scrubbers comprising the step of treating a diethanolamine scrubbing solution with an inhibiting agent in an amount sufficient to inhibit said aldol condensation, wherein said inhibiting agent comprises benzoic hydrazide.

* * * * *